United States Patent [19]

Stroucken

[11] Patent Number: 4,698,053

[45] Date of Patent: Oct. 6, 1987

[54] CENTRIFUGAL SEPARATOR

[75] Inventor: Klaus Stroucken, Ronninge, Sweden

[73] Assignee: Alfa-Laval Separation AB, Tumba, Sweden

[21] Appl. No.: 880,884

[22] Filed: Jul. 1, 1986

[30] Foreign Application Priority Data

Jul. 5, 1985 [SE] Sweden ..... 8503346-2

[51] Int. Cl.[4] ..... B04B 1/08

[52] U.S. Cl. ..... 494/70

[58] Field of Search ..... 494/67, 68, 69, 70, 494/71, 72, 73, 76, 77, 65, 64, 63; 210/781, 782, 360.1, 365, 369

[56] References Cited

U.S. PATENT DOCUMENTS

| | | | |
|---|---|---|---|
| 3,111,490 | 11/1963 | Halbach | 494/70 |
| 3,301,476 | 1/1967 | Hemfort | 494/70 |
| 3,534,903 | 10/1970 | Keith | 494/70 |
| 4,350,282 | 9/1982 | Dudrey | 494/73 |

*Primary Examiner*—Robert W. Jenkins

*Attorney, Agent, or Firm*—Cyrus S. Hapgood

[57] ABSTRACT

In a centrifuge rotor, the separation chamber (21) of which contains a set of conical separation discs (10), these are guided radially by means of guiding means (11) extending axially through the discs. At their ends, the guiding means (11) are fixed relative to the rotor body (1,2) in its periphery direction and radially. The rotor body has an upper part (1) and a lower part (2), which are held axially together at their peripheral portions. A distributor has a base portion (7) on which the separation discs (10) rest, and a neck portion (6) which extends centrally up through the disc set. The distributor is radially guided relative to the lower part and the upper part, respectively, of the rotor body. Cylindrical guiding surfaces (9) are present between the neck portion (6) and the upper rotor part (1) and, possibly, also between the base portion (7) and the lower rotor part (2).

10 Claims, 2 Drawing Figures

CENTRIFUGAL SEPARATOR

Figure 1:
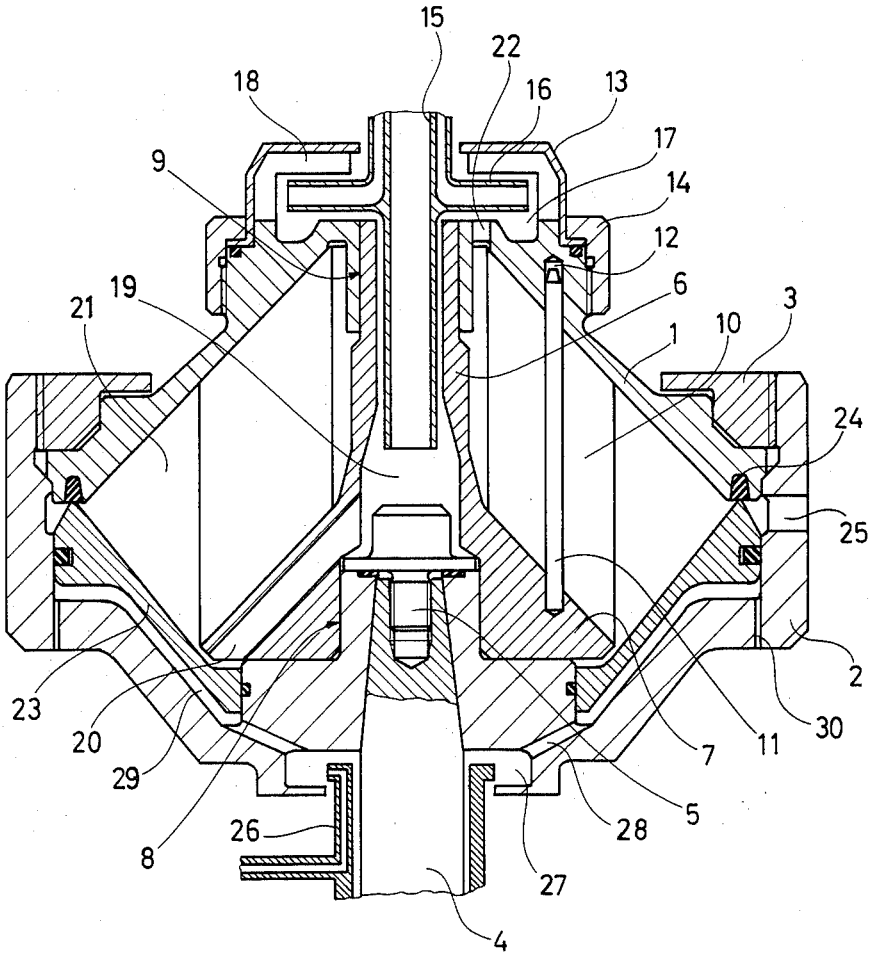

The present invention relates to a centrifugal separator of the kind having a rotor which is supported by a vertical drive shaft and comprises two substantially circular parts, one upper and one lower part, which are arranged coaxially and kept together axially at their respective radially outer edge portions, the lower rotor part being mounted at the top of the vertical drive shaft, and a distributor which is arranged between the rotor parts coaxially therewith and which is provided with an annular conical base portion arranged to conduct liquid from the center of the rotor to a predetermined radial level in the separation chamber of the rotor, and a central neck portion extending upwards from the base portion. The separator comprises also a set of separation discs, each of which has a shape like that of a frustum of a cone with an inner edge and an outer edge, said set of separation discs being arranged coaxially around the neck portion of the distributor, resting against the base portion thereof and leaving an axially directed flow way between the inner disc edges and the neck portion of the distributor for separated liquid, and means for radial fixation of the base portion and the neck portion of the distributor relative to the lower one and the upper one, respectively, of said rotor parts, said upper rotor part axially pressing the disc set against the base portion of the distributor and, thus, the distributor against the lower rotor part.

In previously known centrifugal separators of this kind, the separation discs normally are prevented from moving in the periphery direction relative to the rotor body by engagement with the neck portion of the distributor. Usually the inner edge of each separation disc has one or more recesses, whereas the neck portion of the distributor has corresponding radially and axially extending guiding wings intended to be situated in these recesses.

Upon assembling of a centrifugal separator of this kind, the separation discs are stacked upon each other on the base portion of the distributor, whereafter they are compressed axially by being squeezed together between the above mentioned circular parts of the rotor. In order that the uppermost discs may be maintained in correct positions relative to each other and to the rotor body even before and during said compression, it is required that the neck portion of the distributor and its said guiding wings extend axially a greater distance upwards than would be necessary for the function of these members once the rotor body is assembled. This means that since such centrifugal separators often have, above the neck portion of the distributor, stationary so-called paring means for discharging one or more separated liquids from the rotor, the rotor body itself must be given a corresponding axial extension to make room for said paring means. However, this contradicts a general desideratum that the rotor should be given as small an axial extension as possible, among other things because its balancing during operation should be as good as possible.

Said wings at the outside of the neck portion of the distributor can not be used for taking up large radial forces from the upper circular rotor part. For this reason the mutual radial guidance between the two circular rotor parts must be arranged at their radially outer edges, where the rotor parts are held together axially.

It is difficult, however, to obtain a satisfactory radial guidance between the rotor parts at their outer edges. This is because the rotor parts often have a design such that during the operation of the rotor, one of the rotor parts is subjected to larger deformation in its peripheral direction than the other. This has the consequence that a larger or smaller radial interspace will come up between the guiding surfaces of the rotor parts, which leads to a radial displacement of one of the rotor parts relative to the other. The result will be an unbalance of the rotor for which it is impossible to compensate beforehand, since the direction of the radial displacement cannot be foreseen.

The principal object of the present invention is to provide a rotor design which substantially reduces the balancing problems discussed above.

According to the invention, this object may be achieved in a centrifugal separator of the initially described kind by a combination of features, namely, that a number of guiding means extend substantially axially at a radial distance from the neck portion of the distributor in engagement with the separation discs, that each of the guiding means at both of its ends is fixed radially and in the periphery direction of the rotor relative to both of the said rotor parts, and that said means for the radial fixation of the neck portion of the distributor relative to the upper rotor part comprises a body which is radially fixed relative to the upper rotor part and which has a circular cylindrical surface through which it abuts against a corresponding circular cylindrical surface of the neck portion of the distributor. When possible, said body is preferably manufactured in one piece with the other portions of the upper rotor part.

By the fact that the separation discs are guided radially and in the periphery direction by means of separate guiding means situated at a radial distance from the distributor neck portion, there is no need for guiding wings on the neck portion. Thus, the neck portion may be utilized for an effective central guiding of the upper rotor part in that the neck portion and the rotor part may be provided with cylindrical guiding surfaces. Further, the neck portion need no longer be made axially longer than necessary only to enable mounting of the separation discs. A part of said body with a cylindrical guiding surface can thus be arranged radially inside the uppermost separation discs. In this way the rotor body itself may be given a minimum axial extension.

The invention makes it possible to avoid balancing problems of the kind initially mentioned in connection with centrifugal separators of a certain size.

According to the invention, said guiding means may engage the separation discs in different ways. For instance, the discs may be provided with recesses located at their inner or outer edges and adapted to receive the guiding means. Preferably, however, the guiding means extend through holes in the separation discs situated between their inner and outer edges.

If possible, the distributor base portion rests directly on the lower rotor part along a substantial part of its radial extension. This gives good stability to the distributor neck portion. When this is not possible, for instance if an axially movable slide for uncovering the peripheral outlets from the rotor separation chamber is arranged below the distributor base portion, the distributor preferably is radially fixed relative to the lower rotor part close to the center of the base portion through circular cylindrical surfaces of a substantial axial extension.

Thus, the best possible stability can be achieved in this case for the distributor neck portion.

Figure 2:
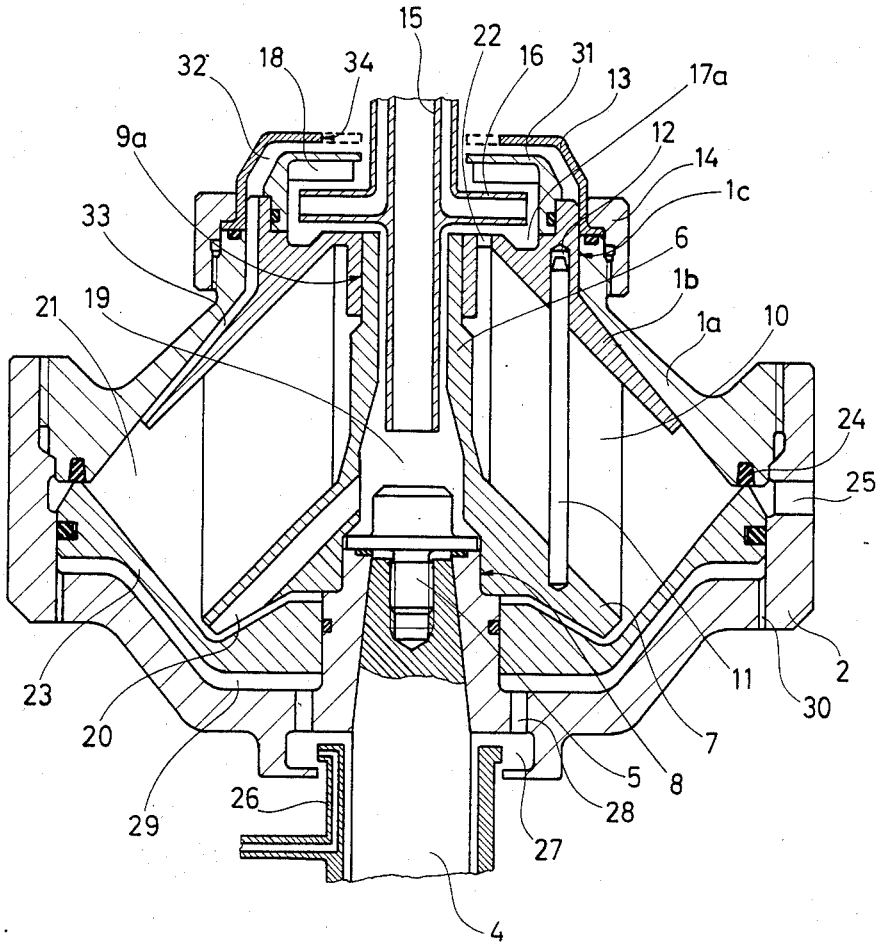

The invention is described in more detail in the following with reference to the accompanying drawings, in which FIGS. 1 and 2 are axial sectional views of different embodiments thereof.

In FIG. 1 there is shown a centrifuge rotor comprising an upper rotor part 1 and a lower rotor part 2. The rotor parts 1 and 2 are held together axially be means of a locking ring 3. The rotor is supported at the top of a vertical drive shaft 4, which is connected with the lower rotor part 2 by fastening means 5.

Centrally within the rotor there is arranged a so-called distributor having a neck portion 6 and a base portion 7. The base portion 7 rests on the lower rotor part 2 and is radially fixed relative thereto via cylindrical guiding surfaces 8 of the rotor part 2 and the distributor 6, 7, respectively.

The distributor neck portion 6 is cylindrical at least at its uppermost part, which is tightly surrounded by the central portion of the upper rotor part 1. The distributor neck portion as well as the center portion of the upper rotor part 1 have cylindrical surfaces 9 which abut against each other along a substantial axial distance.

Around the distributor neck portion 6 and resting on the distributor base portion 7 there is arranged a stack of separation discs 10. Each separation disc has a form like that of a frustum of a cone with an outer and an inner peripheral edge. Axially through the stack of separation discs there are extending a number of guiding means 11 evenly distributed around the rotor axis. The lower end portion of each guiding means is fixed, at least radially and in the periphery direction of the rotor, in a recess in the distributor base portion 7. The upper end portion of each guiding means 11 extends into a recess 12 in the upper rotor part 1, in which it is fixed radially and in the periphery direction of the rotor. In the recess 12 the guiding means 11 is not fixed axially relative to the rotor part 1, however. As can be seen from the drawing, it is guaranteed that the guiding means 11 will not be able to reach the bottom of the recess 12 and thereby influence the mutual axial positions of the rotor parts 1 and 2.

On the upper rotor part 1 there is mounted a cap 13 which is fastened to the rotor part 1 by means of a locking ring 14.

Through a central opening in the cap 13 there extends into the rotor a pipe 15 for supplying a liquid mixture to be treated in the rotor. Supported by the pipe 15 is an annular paring member 16 extending radially out into a paring chamber 17 formed by the cap 13 and the center portion of the rotor part 1. The reference numeral 18 designates liquid entraining wings arranged in the paring chamber 17.

The inlet pipe 15 opens into a central space 19 in the distributor 6, 7, which via inlet passages 20 through the distributor base portion 7 communicates with the separation chamber 21 of the rotor, where the separation discs are situated.

Close to the center but radially outside its abutment against the distributor neck portion 6, the upper rotor part 1 has a number of through holes 22 evenly distributed around the rotor axis, through which holes the separation chamber 21 communicates with the paring chamber 17.

The separation chamber 21 is confined between the upper rotor part 1, the distributor 6, 7 and an axially movable slide member 23. In its position shown in the drawing, the slide member 23 abuts sealingly at its periphery against an annular gasket 24 arranged in a groove in the upper rotor part 1. Thereby, the slide member 23 closes the separation chamber 21 from connection with a number of outlet channels 25 evenly distributed around the rotor axis and extending through the peripheral portion of the lower rotor part 2.

By means of an operation system, the slide member 23 may be caused intermittently, during the operation of the rotor, to open the connection between the separation chamber 21 and the outlet channels 25. This operation system comprises means 26 for the supply of an operating liquid, usually water, to a central chamber 27 formed in the lower rotor part 1. It also comprises channels 28 leading from the chamber 27 to a so-called closing chamber 29 formed between the lower rotor part 2 and the axially movable slide member 23, and throttled outlets 30 from the radially outermost part of the closing chamber 29.

The separating operation of the centrifuge rotor is quite conventional and, therefore, need not be described. Instead, it will be briefly described how the various parts of the centrifuge rotor should be assembled.

After the lower rotor part 2 has been firmly connected with the drive shaft 4, the slide member 23 is inserted. After that, the distributor is placed such that it rests with the distributor base portion 7 on the lower rotor part 2. The separation discs 10 may have been placed on the distributor previously, the guiding means 11 then extending slightly above the uppermost separation disc. Then the upper rotor part 1 is put in place, the stack of separation discs 10 being compressed axially (about 10% of its axial extension), while the locking ring 3 is rotated in threaded engagement with the lower rotor part 2. This means that the guiding means 11 will extend with longer end portions than before above the uppermost separation disc. These end portions extend into the recesses 12 in the upper rotor part 1 and, therefore, do not limit the axial movement downwards of the latter to the intended abutment against the lower rotor part 2. The separation discs 10 and the distributor 6, 7 are thus squeezed firmly to fixation between the rotor parts 1 and 2, the different abutment surfaces between all of these members, as well as the arrangement of the guiding means 11, cooperating to give the rotor a good balance during operation with a maintained center point position.

In FIG. 2 there is shown another embodiment of a centrifuge rotor according to the invention. Details of this embodiment having direct counterparts in details of the embodiment according to FIG. 1 carry the same reference numerals as in FIG. 1.

In the embodiment according to FIG. 2, the upper rotor part is composed of two bodies 1*a* and 1*b*. The body 1*a* is radially guided at its radially outer peripheral edge relative to the lower rotor part 2. The body 1*b* is radially guided through circular cylindrical surfaces 1*c* relative to the body 1*a* and through circular cylindrical surfaces 9*a* relative to the distributor neck portion 6. The body 1*b* is held axially squeezed between the set of separation discs 10 and a portion of the body 1*a* by means of the locking ring 14.

Within the cap 13 there is arranged an annular member 31 which is connected around its periphery with the upper center portion of the body 1*b*. The member 31 forms together with the central portion of the body 1*b* an annular chamber 17*a* which is open radially inwards and constitutes a paring chamber corresponding to the paring chamber 17 in FIG. 1.

Between the member 31 and the surrounding cap 13 there is formed another chamber 32 which also is annular and opens radially inwards. This chamber 32 through a channel 33 communicates with the separation chamber 21 radially outside the separation discs 10 to receive therefrom a relatively heavy separated liquid component. The channel 33 is formed as a radial groove in the upper side of the body 1*b*. The annular edge surrounding the central opening in the cap 13 forms an overflow outlet 34 from the chamber 32 for such relatively heavy separated liquid component. By means of dotted lines it is indicated that the overflow outlet 34 can be arranged at different distances from the centrifuge rotor axis.

I claim:

1. In a centrifugal separator including a rotor defining a separating chamber (21) and having two substantially circular parts, namely, an upper part (1) and a lower part (2) arranged coaxially and held together axially at their respective radially outer edge portions, a vertical drive shaft (4), said lower part (2) being mounted at the top of said shaft (4), a distributor mounted between said rotor parts coaxially therewith and having an annular conical base portion (7) for conducting liquid from the central portion of the rotor to a predetermined radial level in said chamber (21), the distributor also having a central neck portion (6) extending upward from said base portion (7), a set of separation discs (10) each having the form of a frustum of a cone with an inner edge and an outer edge, said set of discs (10) resting against said base portion (7) and being arranged coaxially around said neck portion (6) to leave an axially directed flow way for separated liquid between the inner disc edges and said neck portion (6), and means for securing said base portion (7) and neck portion (6) radially relative to said lower part (2) and said upper part (1), respectively, said upper part (1) pressing the disc set axially against said base portion (7) and thus pressing the distributor against said lower part (2), the improvement comprising a plurality of guiding means (11) extending substantially axially at a radial distance from the distributor neck portion (6) in engagement with the separation discs (10), each guiding means (11) having opposite ends secured radially and in the periphery direction of the rotor relative to said rotor parts (1, 2), said means for securing said neck portion (6) radially relative to the upper rotor part (1) comprising a body radially secured relative to said upper part and having a circular cylindrical surface (9, 9*a*) through which said body abuts against a corresponding circular cylindrical surface of said neck portion (6).

2. Centrifugal separator according to claim 1, in which said guiding means (11) extend through holes in the separation discs (10) between their inner and outer edges.

3. Centrifugal separator according to claim 1, in which the guiding means (11) are fixed at the distributor base portion (7) radially as well as in the periphery direction of the rotor.

4. Centrifugal separator according to claim 1, in which the guiding means (11) at their lower ends are fixed axially at the distributor base portion (7) but at their upper ends are fixed only radially and in the periphery direction of the rotor relative to the upper rotor part (1).

5. Centrifugal separator according to claim 1, in which said guiding means (11) extend axially above the set of separation discs (10).

6. Centrifugal separator according to claim 1, in which the distributor neck portion (6) has an external circular cylindrical surface abutting against a corresponding internal circular cylindrical surface of the said body.

7. Centrifugal separator according to claim 1, in which said body (1*b*) forms one of two portions of the upper rotor part, said body (1*b*) having a circular cylindrical surface (1*c*) which abuts radially against the other portion (1*a*) of the upper rotor part.

8. Centrifugal separator according to claim 1, in which said body (1*b*) comprises a conical disc which is larger than a separation disc (10) and which abuts against the uppermost separation disc.

9. Centrifugal separator according to claim 1, in which said body is formed in one piece with the upper rotor part (1).

10. Centrifugal separator according to claim 1, in which the distributor at its base portion (7) is radially fixed relative to the lower rotor part (2) via circular cyclindrical surfaces (8).

* * * * *